US005967504A

United States Patent [19]

Yankloski

[11] Patent Number: 5,967,504

[45] Date of Patent: Oct. 19, 1999

[54] ENVELOPE FEEDER

[75] Inventor: Richard A. Yankloski, Webster, N.Y.

[73] Assignee: Data Pac Mailing Systems Corp., Webster, N.Y.

[21] Appl. No.: 08/912,132

[22] Filed: Aug. 15, 1997

[51] Int. Cl.[6] ..... B65H 5/00

[52] U.S. Cl. ..... 271/2; 271/110; 271/118; 271/125; 271/126; 271/265.01

[58] Field of Search ..... 271/2, 121, 104, 271/110, 124, 125, 126, 127, 137, 273, 265.01, 265.04, 117, 118, 114

[56] References Cited

U.S. PATENT DOCUMENTS

| | | | |
|---|---|---|---|
| 716,983 | 12/1902 | Barber . | |
| 1,019,158 | 3/1912 | Ielfield . | |
| 1,599,700 | 9/1926 | Davidson . | |
| 1,684,389 | 9/1928 | Ford . | |
| 2,140,170 | 12/1938 | Rouan . | |
| 2,140,171 | 12/1938 | Rouan . | |
| 2,368,519 | 1/1945 | Burckhardt et al. . | |
| 2,381,853 | 8/1945 | Bombard . | |
| 3,506,258 | 4/1970 | Lindquist . | |
| 3,549,067 | 12/1970 | Robbins . | |
| 3,737,158 | 6/1973 | Beery et al. | 271/117 |
| 3,743,275 | 7/1973 | Miller et al. | 271/114 |
| 3,902,712 | 9/1975 | Dorer . | |
| 3,933,350 | 1/1976 | Mignano | 271/125 |
| 3,961,785 | 6/1976 | Gall . | |
| 3,966,193 | 6/1976 | Storace et al. . | |
| 4,131,208 | 12/1978 | Vuilleumier . | |
| 4,193,590 | 3/1980 | Mongagnino | 271/125 |
| 4,437,658 | 3/1984 | Olson . | |
| 4,488,610 | 12/1984 | Yankloski . | |
| 4,544,147 | 10/1985 | Dinnissen . | |
| 4,546,963 | 10/1985 | Dinnissen . | |
| 4,548,395 | 10/1985 | Snellman et al. . | |
| 4,566,685 | 1/1986 | Irvine et al. . | |
| 4,585,223 | 4/1986 | Tam . | |
| 4,603,848 | 8/1986 | Markgraf et al. . | |
| 4,742,878 | 5/1988 | Freeman et al. . | |
| 4,858,905 | 8/1989 | Weigel | 271/125 |
| 4,875,670 | 10/1989 | Peterson et al. | 271/265.01 |
| 4,973,037 | 11/1990 | Holbrook . | |
| 5,104,109 | 4/1992 | Kubo . | |
| 5,163,669 | 11/1992 | Hurd et al. . | |

(List continued on next page.)

FOREIGN PATENT DOCUMENTS

| | | | |
|---|---|---|---|
| 0235331 | 10/1986 | Japan | 271/121 |
| 405147767 | 6/1993 | Japan | 271/125 |

*Primary Examiner*—H. Grant Skaggs
*Attorney, Agent, or Firm*—K. Lukacher; M. Lukacher

[57] ABSTRACT

An improved envelope feeder is provided for single feeding of envelopes which may be of different sizes and thicknesses from a stack of such envelopes. The envelope feeder includes a separation roller having a plurality of disks, and retard members having surfaces which oppose the disks of the separation roller. The roller is movable with respect to the retard members in response to each of the envelopes moving between the surface of the separation roller disks and the retard members. A detector is provided for sensing the presence of each of the envelopes as they each move between the separation roller disks and the retard members. Responsive to this detector, a controller in the feeder automatically controls the spacing of the separation roller disks from the retard members to set the gap between their surfaces to match the thickness of each of the envelopes, whereby the envelopes move singularly between the separation roller disks and the retard members. To advance each of the envelopes from the stack into the gap, a feed roller is provided below a support plate for the stack. This feed roller pivots, responsive to the controller, towards and away from the bottom of the stack through an opening in the support plate to selectably advance each envelope into the gap. A bar may also be provided for applying pressure against the top of the stack towards the support plate. The envelope feeder may be in combination with a mail handling system to provide controlled feeding of single envelopes in such as system.

33 Claims, 8 Drawing Sheets

U.S. PATENT DOCUMENTS 5,238,143 8/1993 Crighton .
5,244,197 9/1993 Helmstadter .
5,301,834 4/1994 Lee et al. ..... 271/118
5,401,013 3/1995 Hurd et al. .
5,443,359 8/1995 Miller et al. ..... 271/111
5,449,162 9/1995 Saito ..... 271/125
5,465,948 11/1995 Weller ..... 271/34
5,520,381 5/1996 Lo et al. .
5,601,282 2/1997 Milo et al. ..... 271/121

FIG. 1A
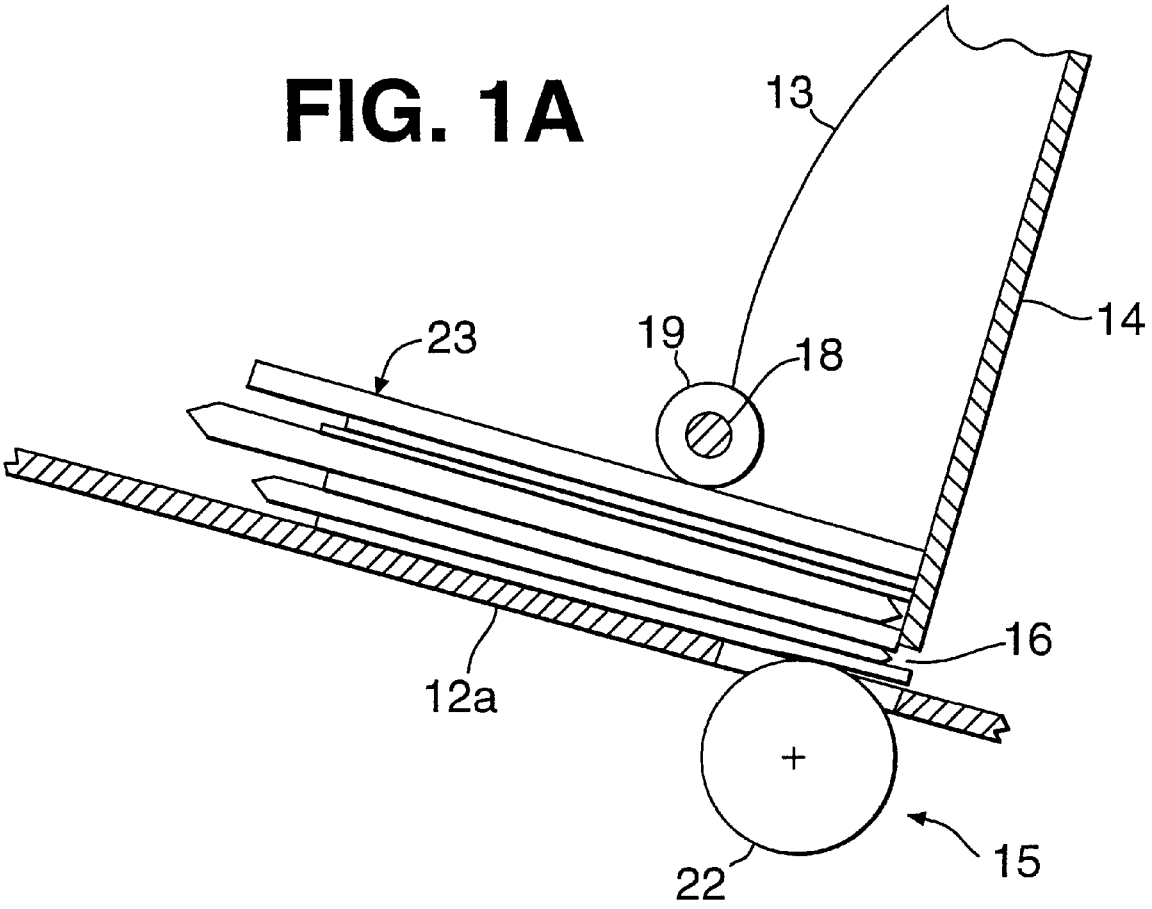
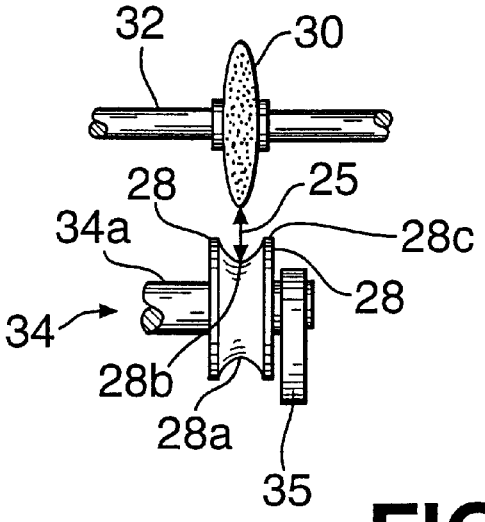
FIG. 1B

ENVELOPE FEEDER

DESCRIPTION

1. Field of the Invention

The present invention relates to an envelope feeder (and method) for single feeding of envelopes, and particularly to, an envelope feeder for single feeding of envelopes from a stack of envelopes having automatic feed gap control. This invention is useful for single feeding of envelopes in mail handling equipment. The invention is generally applicable for single feeding of items, such as sheets of paper or film, or other media which may vary in size and thickness. Thus, the term envelope as used herein should be taken to encompass such other items as well as mailing envelopes.

2. Background of the Invention

Envelope feeders are required for mail handling equipment, such as scales, postage printers and sorters located at different handling stations. The envelope feeders separate and feed individually envelopes to such stations for weighing, marking or sorting. In conventional envelope feeders, envelopes are each driven either by gravity or rollers, or both, through a preset feed gap into the mail handling equipment. This feed gap is manually adjusted for the thickness of the envelopes to provide single envelope feeding. These conventional envelope feeders generally advance envelopes between at least two members in which one member is movable with respect to the other member and urged by a spring force against the other member. The spacing between the two members provides the feed gap. The amount of spring force is manually set in accordance with the thickness of the envelopes to be fed though the feed gap. Examples of such envelope feeders are described in U.S. Pat. Nos. 2,140,170 and 2,140,171 to Rouan, U.S. Pat. No. 2,368,519 to Burckhardt et al., and U.S. Pat. No. 3,902,712 to Dorer.

A problem with conventional envelope feeders is that they have difficulty feeding envelopes having mixed sizes and thicknesses from a stack of envelopes through their feed gap. In such conventional feeders, the feed gap is manually set and the feeders are able to handle envelopes within only a range of envelope thickness. Envelopes with thicknesses below or above this range can cause the envelope feeder to malfunction by feeding multiple envelopes or no envelopes through the feed gap. Such feeding of multiple envelopes at a time in the feed gap can result in the mail handling equipment which receives fed envelopes to jam or cause errors at the other mail handling stations of the equipment. The problem is exacerbated when envelopes in a stack stick together. Conventional feeders have difficultly in separating adjacent envelopes in the stack which may stick together during feeding, because the spring force which sets the feed gap tolerates these adhering envelopes. Then, more than one envelope can enter the feed gap, thereby defeating single feeding of envelopes.

To handle envelopes having various thicknesses in conventional envelope feeders, it has been necessary to sort mail by envelope thickness into different batches and manually reset the feed gap of the envelope feeder for each batch. However, even sorted envelopes may not be reliably separated and fed in conventional feeders because the manually resetting of the fed gap depends upon the relation of spring force applied to a roller, rather than to the actual width of envelopes in the feed gap.

Other approaches have been used in an attempt to prevent multiple envelopes from passing through the feed gap. One approach involves rotating rollers, on opposite sides of the feed gap, in opposite directions such that one roller advances an envelope forward, while the other roller drives other envelopes back toward the stack, see U.S. Pat. No. 4,742,878 to Freeman et al. Another approach, shown in U.S. Pat. No. 5,401,013 to Hurd et al., limits the feed gap by providing stationary separator blocks and rollers in which envelopes pass between the rollers and the blocks, thereby limiting the thickness of envelopes which can be feed. However, the separator blocks must be manually adjusted for the thickness of envelopes to be fed, and thus do not accommodate feeding of mixed thickness envelopes. Still another approach in U.S. Pat. No. 3,966,193 to Storace et al. provides under a stack of envelopes, a driven roller for advancing envelopes which ceases rotating when an envelope is in the feed gap.

SUMMARY OF THE INVENTION

In accordance with a principal feature of the present invention, single feeding of envelopes which may be of mixed sizes and thicknesses is accomplished by automatically controlling the feed gap to the actual thickness of each envelope, thereby providing an envelope feeder which is reliable and avoids the inefficiency in time and labor for batch sorting and resetting of the feed gap.

The present invention further provides an improved envelope feeder which allows for both feeding of envelopes having mixed thicknesses and also feeding of envelopes of uniform thicknesses.

The present invention also provides an improved envelope feeder which provides for automatic control of the feed gap while selectably advancing envelopes from the bottom of a stack into the feed gap and applying pressure upon the top of the stack.

Briefly described, the envelope feeder embodying the invention has a first member with a first surface, and a second member with a second surface opposing the first surface. The first member is movable with respect to the second member in response to each of a plurality of envelopes moving between the surfaces of the first and second members. A detector is provided for sensing the presence of each of the envelopes as they each move between the surfaces of the first and second members. A controller, responsive to the detector, automatically controls the spacing of the first member from the second member to set the feed gap between the surfaces of the first and second members to match the thickness of each of the envelopes, whereby the envelopes move singularly between the first and second members.

The first member may include a plurality of the first members to provide a plurality of the first surfaces spaced from each other along the length of the envelopes, while the second member includes a plurality of the second members to provide a plurality of the second surfaces spaced from each other along the length of the envelopes. Each of the first surfaces has a continuous annular surface which interfit with a different one of the second surfaces. The plurality of first members are part of a separation roller which is pivotable with respect to the second members along a path. The first members are urged by spring force against the second members. The controller operates a brake, coupled to the separation roller, to lock and release the position of the separation roller along its path and the position of the first members with respect to the second members, thereby automatically controlling the feed gap.

The envelope feeder can accommodate envelopes over a wide range of different thicknesses in that the controller changes the spacing between the first and second members so that the feed gap between their opposing surfaces matches the thickness of each envelope. Further, the envelope feeder can accommodate envelopes which are uniform in thickness in that the controller locates the first and second members into fix positions to set the feed gap to the uniform thickness during feeding of such envelopes through the feed gap.

The envelopes to be fed by the envelope feeder are in a stack which is supported by top and back support plates. The top support plate presents a surface to position the envelopes for single feeding between the first and second members. To advance each of the envelopes into the feed gap, a feed roller below the top support plate pivots, upon actuation by the controller, towards and away from the bottom of the stack through at least one opening in the top support plate. A bar movable with respect to the stack may also be provided on top of the stack. This bar is coupled to a driving mechanism for applying pressure with the bar against the stack towards the top support plate surface. The bar then can apply pressure onto the lower-most envelope of the stack when the envelope engages the feed roller to advance it into the feed gap.

BRIEF DESCRIPTION OF THE DRAWINGS

The invention and the features and advantages thereof will be more apparent from the following description and accompanying drawings in which:

FIG. 1A is a side elevation showing a stack of envelopes on a support of the envelope feeder of FIG. 1;

FIG. 1B is a fragmentary sectional view along line 1B—1B in FIG. 2 showing separation and retarding members which form the feed gap;

DETAILED DESCRIPTION OF THE INVENTION

Figure 1:
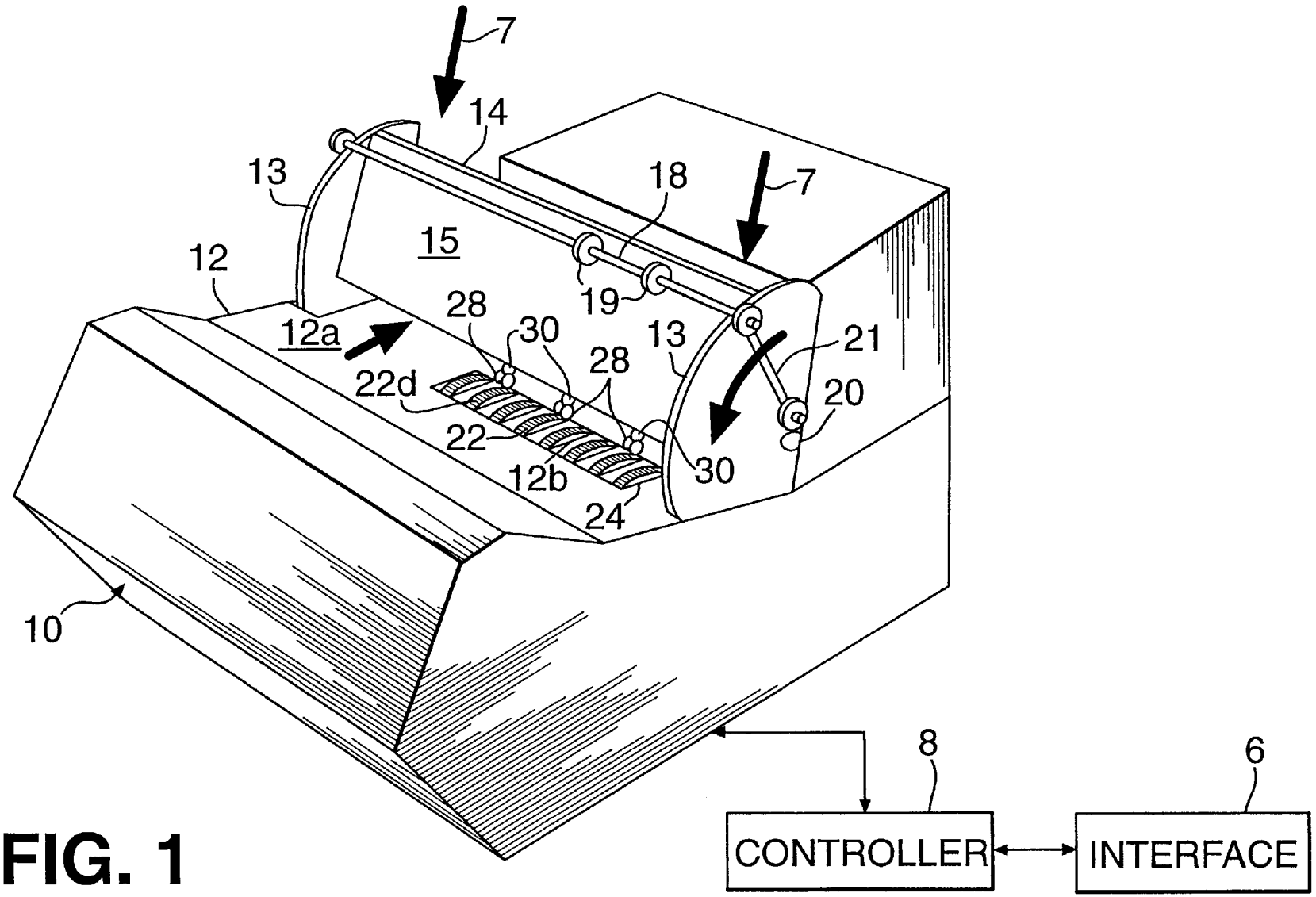
FIG. 1 is a perspective view of an envelope feeder in accordance with a presently preferred embodiment of the invention.
Figure 2:
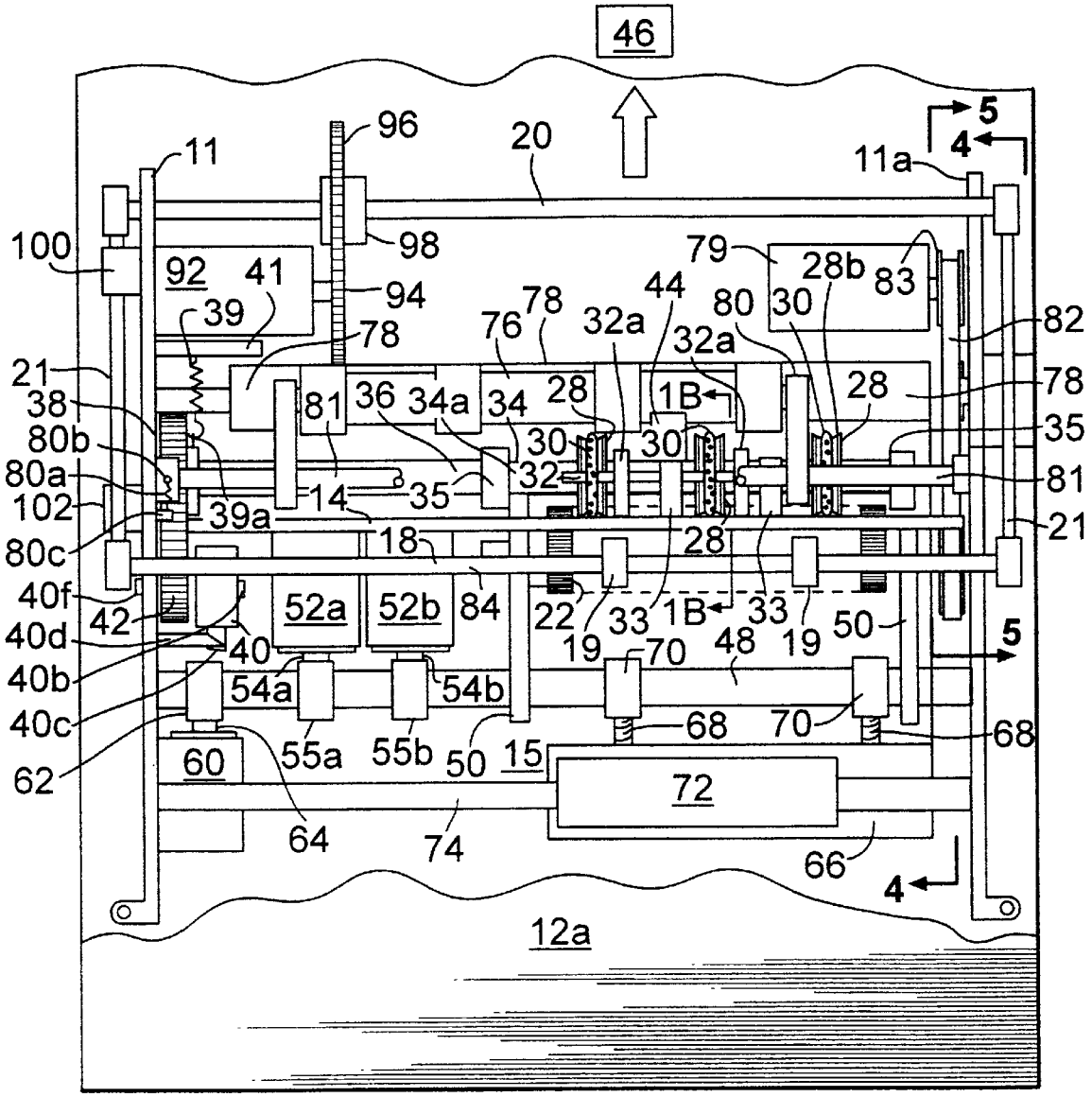
FIG. 2 is a top view of the envelope feeder of FIG. 1 broken away below the top support plate of the envelope feeder housing, in a direction parallel to the back plate of the feeder (as indicated by arrows 7), to show the mechanism of the feeder.

Referring to the drawings, and particularly FIG. 1, an envelope feeder 10 is shown having a housing 12 which contains the envelope separating and feeding mechanism. Housing 12 has a top support plate 12*a* on which a stack of envelopes is supported against a back plate 14. Back plate 14 is attached to side plates or members 13 which are connected to side frame members 11 and 11*a* of the separating and feeding mechanism. The separating and feeding mechanism 15 is shown in FIG. 2 where the support plate 12*a* is broken away to expose that mechanism.

Figure 4A:
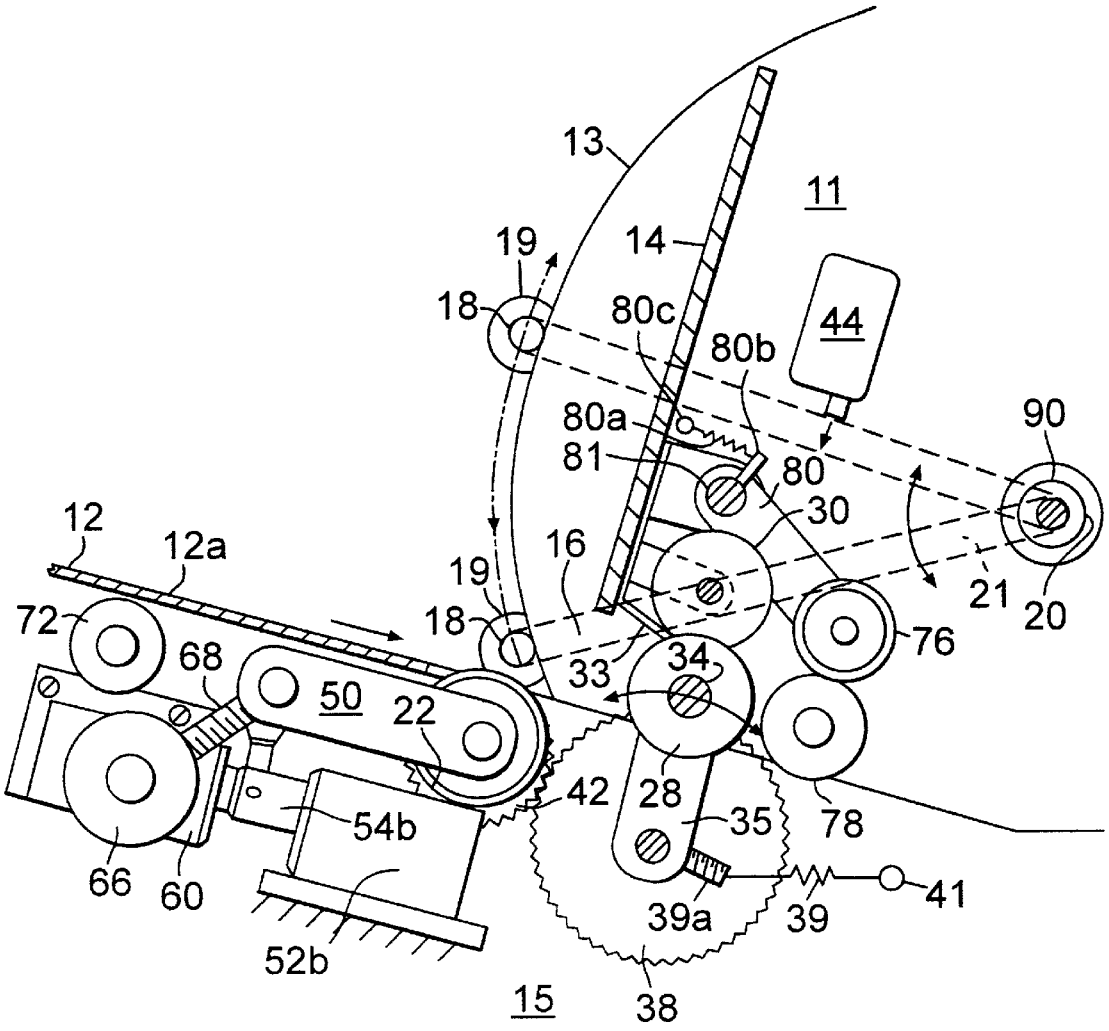
FIG. 4A is a sectional view along lines 4A—4A in FIG. 2 without an envelope in the feed gap and showing two exemplary positions of the pivotal pressure bar of the feeder.

FIG. 1 shows a bar 18 which moves along an arcuate path following the contour of the edge of side plates 13. Bar 18 has a plurality, for example two, rollers 19 which are preferably journalled in ball bearings to the bar. Bar 18 is pivotally connected to a shaft 20 which is journalled in bushings in side plates 13. Shaft 20 is shown in detail in FIG. 2. Arms 21 are connected between shaft 20 and bar 18 so that the bar rotates with the shaft and pivots along the arcuate path. Examples of two positions of bar 18 along its arcuate path are shown in FIG. 4A. Bar 18, via rollers 19, applies pressure downwardly against the stack of envelopes 23, as shown for example in FIG. 1A, until the envelope at the top of the stack is fed by mechanism 15 through an opening 16 between back plate 14 and the surface of support plate 12*a*. Bar 18 then automatically retracts and pivots upwardly by a mechanism which actuates shaft 20, as will be described in detail hereinafter.

Side frame members 11 and 11*a* extend upwardly and with side members 13 provide a framework supporting back plate 14, shaft 20, and the mechanism for actuating shaft 20. Side frame members 11 and 11*a* are also attached to housing 12, for example, by flanges (not shown) which extent laterally and inwardly from the side walls of housing 12. This attachment locates support plate 12*a* at an angle of approximately 20 degrees to the horizontal. Back plate 14 is disposed approximately perpendicular to the surface of support plate 12*a*, but is preferably tilted backwardly approximately 5 degrees from a plane perpendicular to the surface of support plate 12*a*. This angular orientation is provided so that the stack of envelopes 23 has a sufficient force applied thereto by virtue of the weight of the stack so that the lower side of the envelope at the bottom of the stack rests on the top surface of support plate 12*a* and the edges of the envelopes in the stack rest against back plate 14. The long edges of the envelopes preferably rest against back plate 14 so that the envelope is driven in a direction across its width. While not preferred, mechanism 15 may be reoriented so that the envelopes are driven in a direction across their length.

Figure 3A:
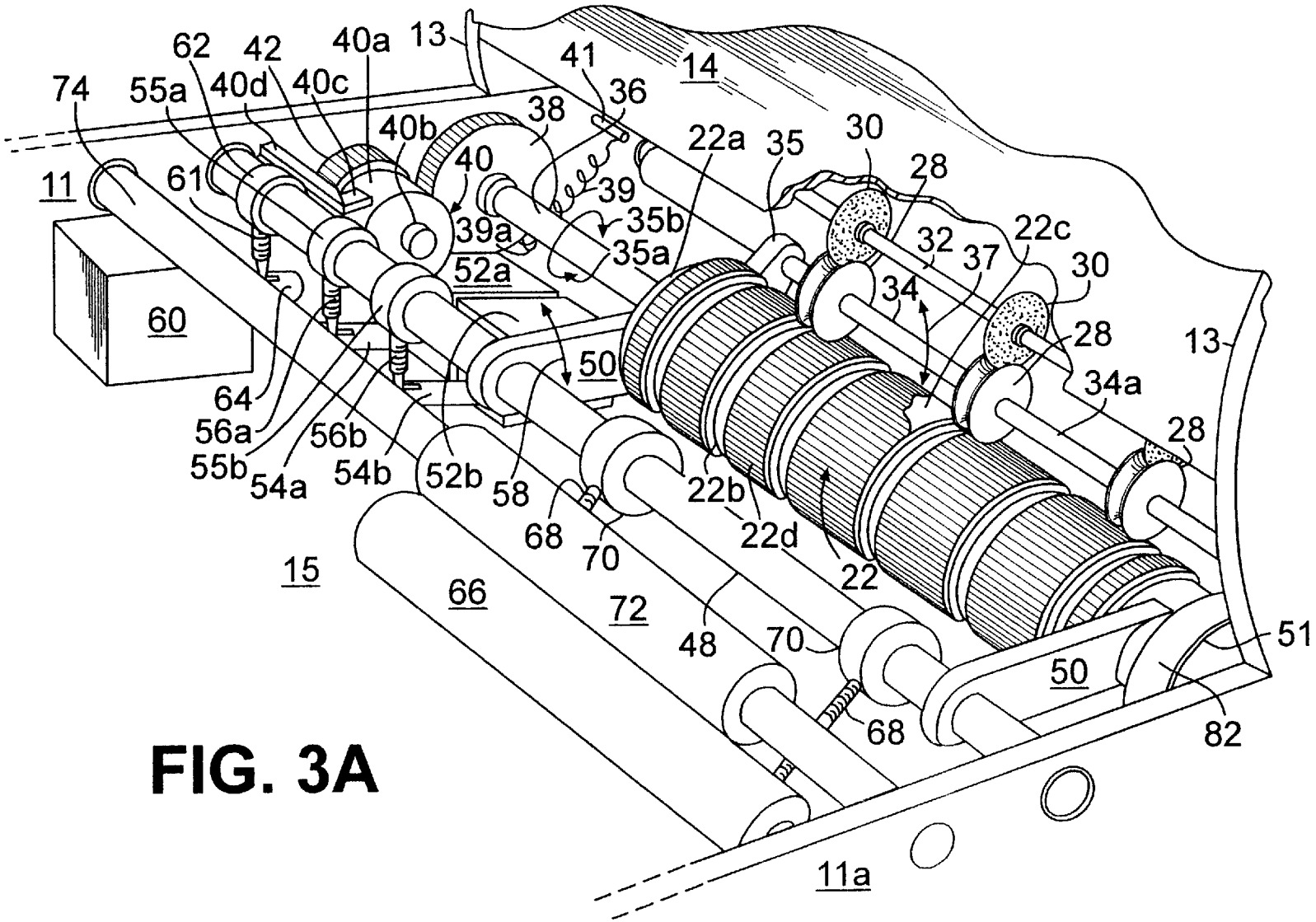
FIG. 3A is a perspective view below the top support plate of the envelope feeder showing part of the mechanism shown in FIG. 2.

A feed roller 22 extends across the length of the envelopes in the stack and projects through an opening 24 in support plate 12*a*. The feed roller assembly, as best shown in FIG. 3A, has a cylinder 22*a* having notches 22*b* which provides a series of steps 22*c* on the surfaces of which are mounted rubber tires 22*d*. Tires 22*d* may be grooved so as to increase the frictional force on the envelopes in the direction of feeding, and are held on steps 22*c* by the force of their own elasticity. Adhesive may be used to attach tires 22*d* to steps 22*c*, if desired. Between tires 22*d* and overlying notches 22*b* are stripes or bars 12*b* (FIG. 1) which are part of support plate 12*a*. Bars 12*b* provide support for the lowest-most envelope in the stack and maintains the bottom surface of the envelope generally in the plane of the top surface of support plate 12*a*.

Figure 5:
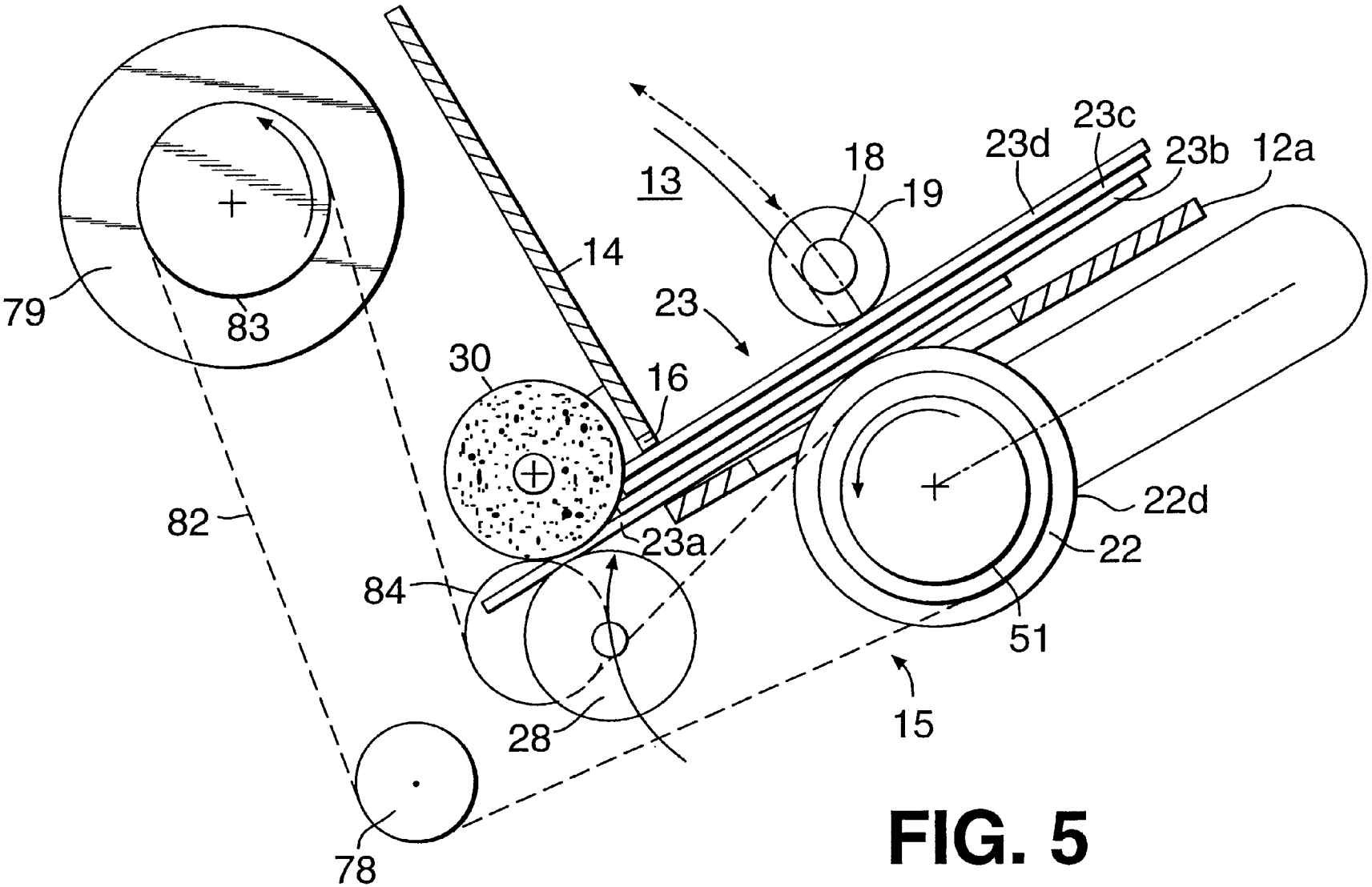
FIG. 5 is a sectional view along line 5—5 in FIG. 2.

Feed roller 22 is pivotal on a shaft 48 of mechanism 15 by arms 50. Cylinder 22*a* of feed roller 22 is journalled in arms 50 so that the roller may rotate. Feed roller 22 is positively driven by a pulley 51 and a belt 82. Belt 82 is a timing belt having groves on its inside surface. This belt 82 extends around a pulley 83 driven by a main feed drive motor 79, and also extends around an exit roller 78 and pulley 51 on the end of feed roller 22. Belt 82 is tensioned by a roller 84 which is journalled in the upper extension of the right side frame member 11*a*. The rollers 22, 78 and 84 and motor drive described above are shown in FIG. 5, which is taken along the right side frame plate 11*a* (line 5—5 shown in FIG. 2). Plate 11*a* is broken away to show the rollers and pulleys which are mounted thereon. Belt 82 has sufficient flexibility and stretch to allow feed roller 22 to pivot downwardly and upwardly as shaft 48 is rotated. When roller 22 is pivoted downwardly, its tires 22*d* are below the surface of the support plate 12*a* and out of the driving engagement with the bottom envelope in the stack. When roller 22 is pivoted upwardly, its tires 22*d* engage the bottom envelope of the stack and drives that envelope through opening 16, and in particular, through the feed gap of mechanism 15. One envelope is driven at a time through the feed gap by mechanism 15 for selectably advancing each envelope in the stack by controlling the pivoting of roller 22, as will be described in the discussion of the operation of feeder 10.

Behind opening 16 there are provided components of mechanism 15 which sets the size of the feed gap automatically in accordance with the thickness of the envelope which is feed. This mechanism provides an important feature of the invention for automatically controlling the size of the gap so that it can pass a single envelope and takes into consideration the thickness of the envelope which may vary from envelope to envelope.

Figure 3B:
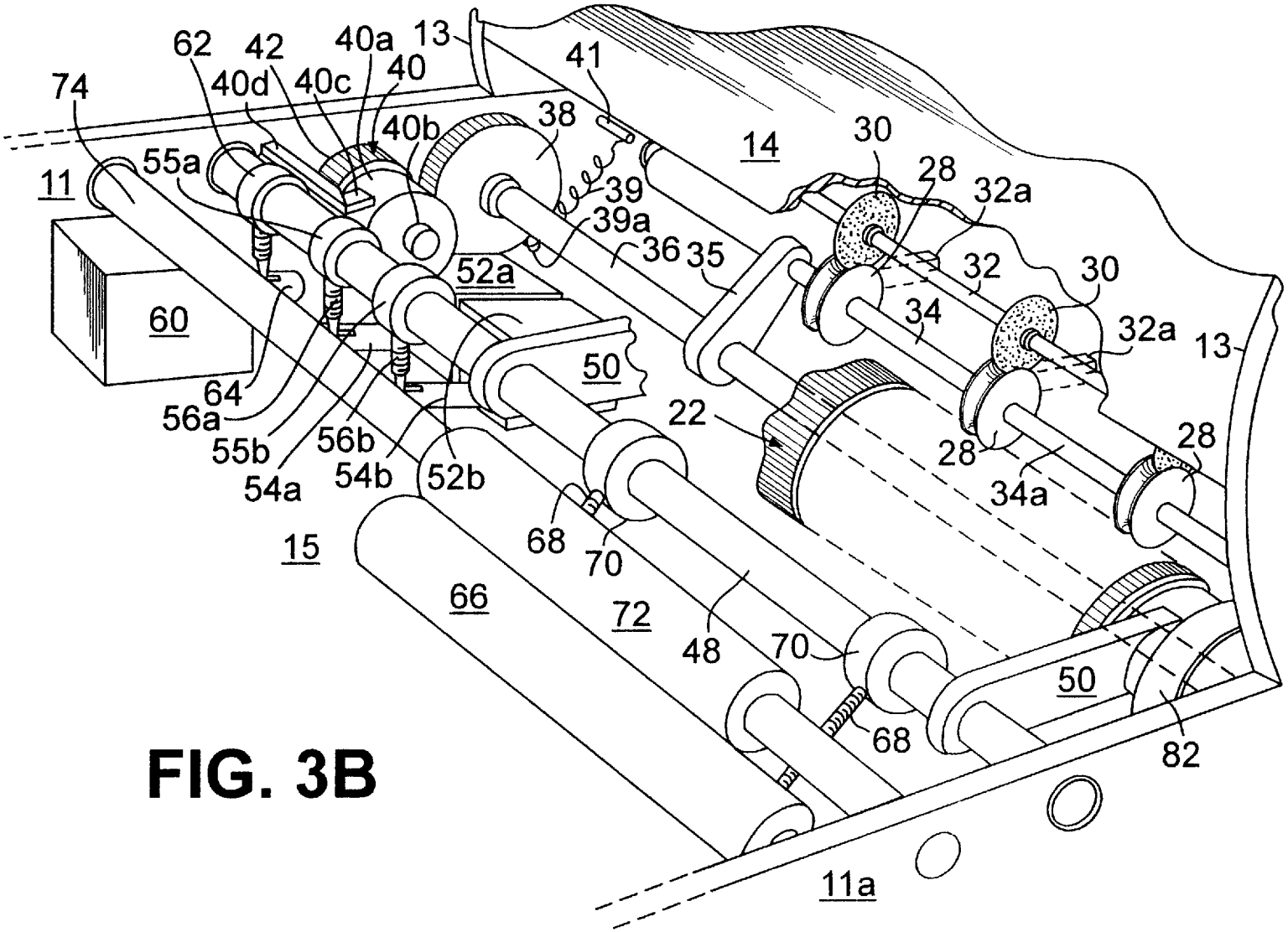
FIG. 3B is another perspective view similar to FIG. 3A with the feed roller partially removed.

This gap control mechanism has a separation roller 34 having a plurality of (three in the illustrated embodiment) cylinders or disks 28 along a shaft 34*a*. Disks 28 and shaft 34*a* rotate as a unit. Disks 28 are spaced from each other along the edge of opening 24 in support plate 12*a*. Support plate 12*a* may have cut out openings (not shown) through which disks 28 may upwardly extend into opening 16. As shown in FIG. 1B, each disk 28 has a concave surface or groove 28*a*. Shaft 34*a* is journalled in arms 35 such that shaft 34*a* may rotate in arms 35. Alternatively, disks 28 may be independently rotatable on shaft 34*a* by bearings and shaft 34*a* fixed to arms 35. Arms 35 are attached and rotated by a shaft 36 (see FIG. 3B). Shaft 36 has a spur gear 38 at an end thereof near the left side frame member 11. The opposite ends of shaft 36 are journalled in side frame members 11 and 11*a*. Gear 38 is in engagement with a gear 42, which is part of a magnetic clutch/brake assembly 40. Assembly 40 is mounted to side frame member 11. A magnetic clutch/brake 40*a* in assembly 40 has an exterior stator 40*b*. Stator 40*b* is fixed and prevented from rotating by an ear 40*c* which engages a bar 40*d* extending inwardly from side frame member 11. Gear 42 of the magnetic clutch/brake assembly 40 is connected to the armature of a magnetic clutch/brake 40*a* and may rotate about a stub 40*f* (FIG. 2) which connects the magnetic clutch/brake 40*a* to side frame member 11. A bias spring 39, attached to a crank pin 39*a* on shaft 36, is connected between shaft 36 and a spacer shaft 41. Shaft 41 may extend between side frame members 11 and 11*a*, or shaft 41 may provide a post from side frame member 11. Spring 39 bias shaft 36 in a counterclockwise direction as shown by arrowhead 35*a* in FIG. 3A. Accordingly, disks 28 of separation roller 34 are biased against stationary envelope retarding members or disks 30. One disk 30 is provided for each of the separation roller's disks 28. The peripheral surface of each of these retarding disks 30 is convex so that each retarding disk 30 fits into opposing concave surface 28*a* of disk 28 (FIG. 1B). The space between the surface of each disk 28, from its outer rims 28*b*, and the opposing surface of its interfitting disk 30 represents the feed gap of mechanism 15. An exemplary feed gap 25 is shown in FIG. 1B.

Retarding disks 30 are preferably made of ceramic material, such as found in sharpening stones, and presents a rough, high friction surface. Disks 30 thus provide a surface having a greater coefficient of friction than disks 28. Disks 30 are fixed to a shaft 32 mounted to back plate 14 by tabs 32*a*. Alternatively, each disk 30 may be separably fixed by tabs to back plate 14 and aligned along a common axis through the center of each disk 30. Disks 28 and 30 may represent one or more pairs of opposing members in which each pair has one stationary member 30 and one member 28 pivotable with respect to the stationary member to set the feed gap, and are thus not limited to disks or circular members.

Extending from back plate 14 are deflector plates 33, for example two, which deflect each envelope as it leave gap 25 between retarding disks 30 and the separation roller disks 28, so that the envelope is guided into the nip between exit roller 78 and a pressure roller 76. Optionally, instead of plates 33, the exiting path of the envelope from gap 25 may be aligned with the nip between rollers 76 and 78 such that each envelope upon leaving gap 25 is positioned at this nip. Pressure roller 76 is pivotally mounted in arms 80 on a shaft 81. Shaft 81 is journalled in the upper extension of side frame plates 11 and 11*a*. A bias spring 80*a* is connected between a crank pin 80*b*, which extends from pressure roller 76, to a pin 80*c* in left side frame member 11. Spring 80*a* biases pressure roller 76 against exit roller 78.

The control mechanism for setting the size of the gap is an electromechanical component of mechanism 15 since it uses an electromagnetic clutch/brake 40*a*. This clutch/brake 40*a* is connected to a controller 8 (FIG. 1). Although illustrated external to housing 12 in FIG. 1, controller 8 is preferably on a printed circuit board contained in housing 12. The controller has switches which are responsive to the presence of an envelope in the gap as the envelope moves between disks 28 and 30. Specifically, these switches upon detection of the forward edge of an envelope in the gap, and effectively to the detection of the size of the gap required by the envelope, apply current to clutch/brake 40*a* to hold and lock separation roller 34, thereby controllably setting the size of the gap in accordance with the thickness of the envelope then in the gap. The switches of controller 8 also respond to the detection of the trailing edge of the envelope (i.e., the edge of the envelope opposite its forward edge) in the gap by removing the current to clutch brake 40*a* to unlock separation roller 34 and reset the gap for receiving the next envelope. The operation of controller 8 and this gap controlling mechanism will be set forth in greater detail hereinafter.

The actuation or pivoting of feed roller 22 is synchronized with the setting of the gap between the separation roller disks 28 and retarding disks 30 by controller 8. The feed roller mechanism of mechanism 15 includes a counterbalance 66 which is connected by crank pins 68 and collars 70 to shaft 48. Thus, rotation of shaft 48 pivots feed roller 22 and counterbalance 66 together. A shaft 74 extends between side frame members 11 and 11*a* and carries a bar having a stop cylinder 72. Stop cylinder 72 is located for stopping counterbalance 66 upward movement, thus limiting the downward movement of feed roller 22. Counterbalance 66 and stop cylinder 72 may be covered with resilient material for damping and noise reduction purposes.

Shaft 48, which pivots feed roller 22, is driven by a plurality of solenoids 52*a*, 52*b* and 60. Solenoids 52*a*, 52*b*, and 60 have their armatures 54*a*, 54*b*, and 64, respectively, connected to crank pins 56*a*, 56*b*, and 61, respectively, which are fixed to shaft 48 by collars 55*a*, 55*b*, and 62, respectively. The pair of solenoids 52*a* and 52*b* are used to provide sufficient rotational torque upon shaft 48 when armatures 54*a* and 54*b* pull in to raise feed roller 22 to an up position where its tires 22*d* extend through opening 24 between bars 12*b* in support 12*a*. Feed roller 22 is shown in its up position in FIG. 1. Solenoids 52*a* and 52*b* are attached to a support plate which extends between side frame members 11 and 11*a*. This support plate is not shown to simplify the illustration. The other solenoid 60 may be connected to side frame member 11. Solenoid 60 is for the principal purpose of locking feed roller 22 in its down position, i.e., out of contact with envelopes on the surface of support 12*a*. A locking force has been found preferable to prevent bouncing of feed roller 22 during operation. Although a pair of solenoids 52*a* and 52*b* are used to apply torque to shaft 48 for pivoting feed roller 22, a single solenoid can alternatively be used.

Returning to bar 18, the mechanism which actuates shaft 20 to apply force to the upper envelope in the stack will be described. A spur gear 96 is mounted on shaft 20, as shown in FIG. 2. As stated earlier, arms 21 connect shaft 20 to bar 18 such that rotation of shaft 20 pivots bar 18. Spur gear 96 engages a gear 94 which is driven by a bidirectional motor 92. Motor 92 is attached to the upper extension of side frame member 11. However, spur gear 96 is connected to shaft 20 by way of a mechanical slip clutch 98. Accordingly, the amount of force applied to the stack of envelopes by bar 18 is limited by slip clutch 98, and motor 92 can continuously drive so as to pivot bar 18 and maintain force (pressure) on the stack of envelopes regardless of the height of the stack on the surface of plate 12*a*.

Limit switches 100 and 102 extend outwardly from the left side frame member 11 extension 13 and are located to define the upper limit and lower limit, respectively, of movement of bar 18. Lower limit switch 100 is connected to motor 92 to change the direction of rotation of motor 92 when the left arm 21 hit lower limit switch 102 so that motor 92 rotates shaft 20 to pivot bar 18 back to its upper position. When bar 18 reaches the upper position, the upper limit switch 100 is then contacted by left arm 21, causing motor 92 to stop. With bar 18 in the upper position, an operator can insert another stack of envelopes, or can stow bar 18 until needed. Upon pushing bar 18 downwardly, the release of switch 100 from arm 21 causes motor 92 to rotate and pivot bar 18 in the downward direction (i.e., towards the surface of support plate 12*a*) against the stack of envelopes. Separate motor controllers (relays) are operated by switches 100 and 102 so as to obtain the actuation of bar 18 as just described.

Attached on a bracket (not shown) to the rear side of back plate 14 is a photo emitter/detector ("opto") 44. Opto 44 has a source of light (an LED) and optics which direct a light beam at the exit from the gap between disks 28 and 30. The beam intercepts the forward edge of the envelope while the envelope is still in the gap just before the envelope starts entering the nip between exit roller 78 and pressure roller 76, thereby sensing when an envelope in the gap. The beam continues to be intercepted as the envelope passes through the gap. When the envelope has left the gap, opto 44 senses the trailing edge of the envelope by its beam no longer being intercepted. By detecting the forward and trailing edges of the envelope, opto 44 senses the presence of the envelope in the gap as it moves between disks 28 and 30. Opto 44 sends signals to controller 8 when the forward edge of an envelope is detected, and then when the trailing edge of the envelope is detected.

Another photo emitter/detector ("opto") 46 may be mounted in envelope feeder 10 in the exiting path of envelopes from the feeder, and may be similar to opto 44. Opto 46 is located to sense when an envelope leaves feeder 10 or has left the next mail handling or transport station (not shown) into which envelopes are fed. This next station may have its own envelope drive mechanism, or exit roller 78 may drive the envelope to the station. In any event, the second opto 46 determines when to feed the next envelope. Rather than using a separate opto 46, the next station, or stations, through which a fed envelope is transported, may provide signals to controller 8 to feed the next envelope which are indicative of the envelope exiting one or more of the stations.

Motor 79 which drives exit roller 78 and feed roller 22 is controlled by controller 8. Motor 79 may be enabled by controller 8 for feeding of a stack of envelopes through feeder 10, or motor 79 may be turned on for a sufficient period of time for feed roller 22 to be actuated to move an envelope into the gap and for exit roller 78 to grab the envelope and accelerate it out of the feeder. The operation of controller 8 in response to optos 44 and 46 is described hereinafter in connection with the discussion of the operation of envelope feeder 10.

Controller 8 acts responsive to input from an operator entered via an interface 6. Although shown external to feeder 10 in FIG. 1, interface 6 is preferably on housing 10. Interface 6 may be for example, a keyboard and display, or one or more buttons or switches. Also, envelope feeder 10 may operate in either automatic or batch mode. Batch mode is used when envelopes to be fed are uniform in thickness, such as in bulk mailing, while automatic mode may be used for feeding envelopes having either uniform or mixed thicknesses.

Figure 4B:
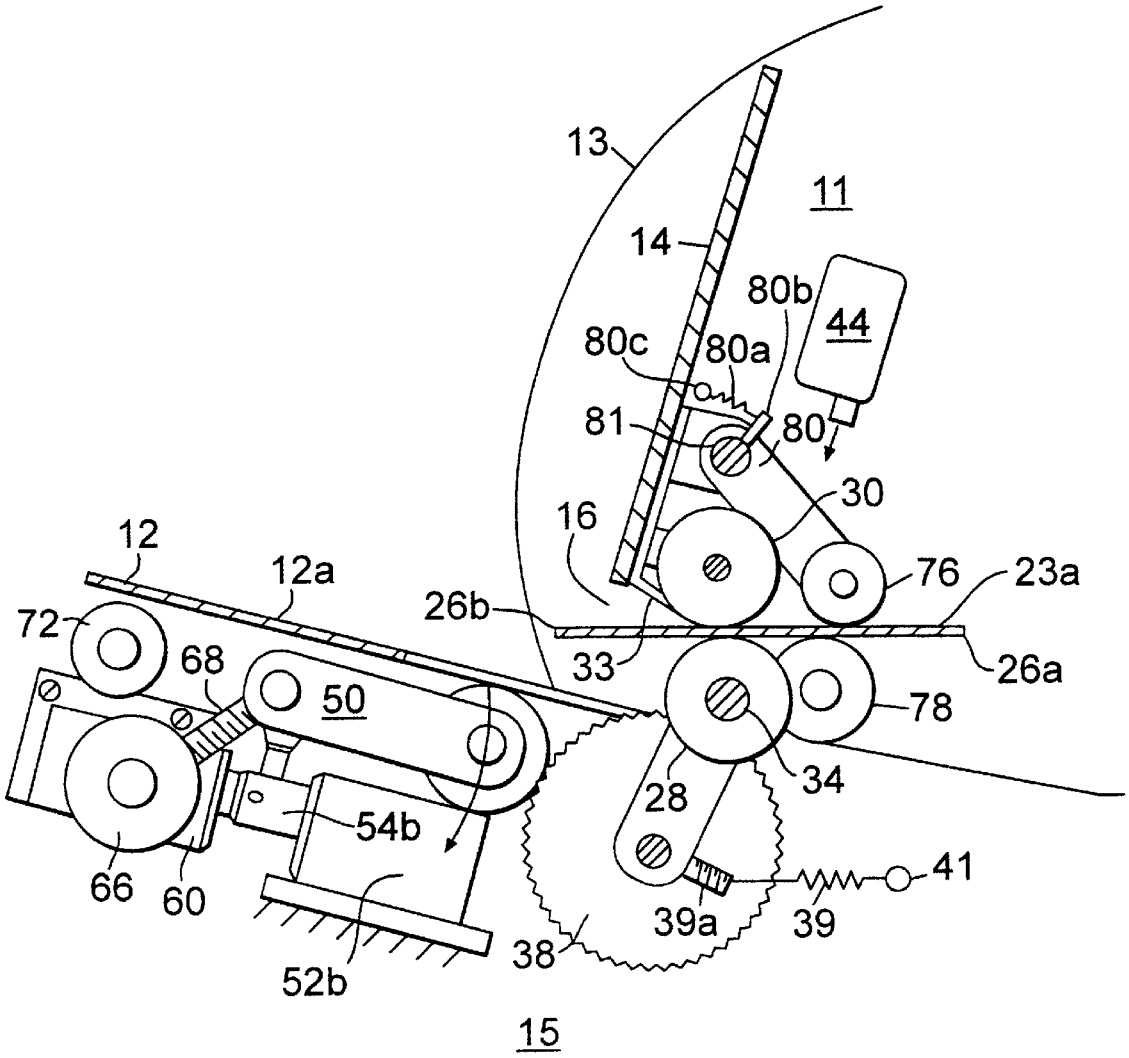
FIG. 4B is a sectional view similar to FIG. 4A when an envelope is in the feed gap.

Referring to FIGS. 4A and 4B, the operation of the envelope feeder will be described. FIG. 4A shows disks 28 and 30 in interfitting relationship with each other, while FIG. 4B shows an example of the feed gap set to the thickness of an envelope 23*a* between disks 28 and 30 and the pivoting of roller 22, 34, and 76. The operator first selects either automatic or batch mode via interface 6. For automatic mode, the operator places a stack of envelopes on lower support 12*a* such that one of the longer sides or edges of each envelope rests and is generally registered against upper support 14. The operator may optionally lower bar 18 onto the top of the stack by lightly moving the bar downward from it upper position. This releases switch 100, causing motor 92 to rotate shaft 20 and pivot bar 18 downwards, thereby automatically lowering bar 18 into position upon the stack. Once bar 18, via rollers 19, reaches the top of the stack, rotational torque continues to be applied to shaft 20 by motor 92, while slip-clutch 98 allows gear 96 mounted to shaft 20 to slip responsive to the applied torque, thereby applying pressure against the stack on support plate 12*a*.

In automatic mode, the operator presses a start button or enters a start command on interface 6. In response (and with clutch/brake 40*a* released), controller 8 sends an actuate signal to solenoids 52*a* and 52*b*, causing solenoids 52*a* and 52*b* to pulls in their respective armatures 54*a* and 54*b*, and rotating shaft 48 counterclockwise. In addition to sending actuate signals to solenoids 52*a* and 52*b*, controller 8 also sends a disable signal to solenoid 60, allowing its armature 64 to move with the rotation of shaft 48. Without an envelope yet in the feed gap, separation roller 34 is pressured by the force of spring 39 applied to shaft 36, such that disks 28 on roller 34 interfit with disks 30.

The counterclockwise rotation of shaft 48 pivots feed roller 22 to an up-position, where feed roller 22 engages the lower-most envelope in the stack by tires 22*d* which extend through openings 24 between bars 12*b*, thereby advancing that envelope into the feed gap. In response to the advancing envelope moving into the feed gap between disks 28 and 30, separation roller 34 pivots downward along a path 37, rotating shaft 36 and gear 38 clockwise, as shown by arrowhead 35*b* (FIG. 3A). Disks 30 retard other envelopes, which are in the stack above the envelope being advanced, from entering into the feed gap. This is shown, for example, in FIG. 5 where envelopes 23*a*, 23*b*, 23*c*, and 23*d* represent the lowest to highest envelopes of stack 23, and envelopes 23*b–d* are held back by the rough surface of disks 30 as envelope 23*a* moves between disks 28 and 30. When opto 44 senses the forward edge 26*a* of the envelope emerging from the feed gap, it sends a signal to controller 8 indicating the detection of the forward edge of an envelope in the feed gap, and in response, controller 8 sends a signal to clutch/brake 40*a* to actuate, a signal to solenoids 52*a* and 52*b* to disable, and a signal to solenoid 60 to actuate. When clutch/brake 40*a* actuates, gears 42 and 38 lock to fix shaft 36. This fixes separation roller 34 and its disks 28 in position, thereby setting the feed gap to match the thickness of the envelope between disks 28 and 30. Due to the envelope moving in the feed gap and the delay between controller 8 receiving the signal from opto 44 and the actuating of clutch/brake 40*a* responsive to a signal from controller 8, a substantial portion of the envelope coinciding with its thickness lies between disks 28 and 30 when clutch/brake 40*a* actually actuates to fix the position of separation roller 34 and disks 28 along path 37. Further, with solenoids 52*a* and 52*b* no longer actuated, the weight of roller 22, as offset by counterbalance 66, moves roller 22 downwards into a down position and out of engagement with the stack. The downward movement of roller 22 is limited by stop cylinder 72, which restricts the upward movement of counterbalance 66. Actuation of solenoid 60 causes its armature 64 to pull in, locking roller 22 in its down position.

As the forward edge of the envelope exits the feed gap, it enters the nip between exit roller 78 and pressure roller 76. Pressure roller 76 pivots upwards, against the force of spring 80*a*, in response to the envelope passing between rollers 76 and 78. Exit roller 78 grips the envelope and pulls it through the gap. When the trailing edge 26*b* of the envelope leaves the gap, the trailing edge is sensed by opto 44, which sends a signal to controller 8 indicating the detection of the trailing edge, thereby informing the controller that the envelope is no longer in the gap. In response, controller 8 sends a signal to clutch/brake 40*a* to release. The release of clutch/brake 40*a* unlocks gears 42 and 38, which allows shaft 36 to rotate by the force of spring 39, and separation roller 34 to pivot upwards for resetting the feed gap. Exit roller 78 next accelerates the envelope out of envelope feeder 10, such as to a subsequent mail processing station or module.

Controller 8 then waits for a signal from opto 46 to determine when to feed the next envelope. Upon receiving the signal from opto 46, controller 8 sends signals to actuate solenoids 52*a* and 52, and to disable solenoid 60. Feed roller 22 again pivots into its up position to engage the stack due to rotation of shaft 48 caused by solenoids 52*a* and 52*b*. The above operation then repeats for the next lowest envelope in the stack, until all envelopes in the stack are separated and singularly fed. In this manner, automatic control of the feed gap is achieved to singularly feed envelopes of different thicknesses and sizes. As stated earlier, in the alternative to opto 46, controller 8 may receive a signal from subsequent envelope handling or transport station indicating when to feed the next envelope. In a further alternative, instead of using opto 46, controller 8 may wait a predefined interval before sending signals to solenoids 52*a*, 52*b* and 60 for pivoting feed roller 22 to engage the stack. This interval may be set by a timer in controller 8 and based on the desired rate of envelope feeding.

When bar 18 is used during the feeding of envelopes, bar 18 continuously applies downward pressure upon the top of the stack, thereby urging engagement of tires 22*d* of feed roller 22 when roller 22 is in an up position. This facilitates feeding of envelopes up to the last envelope in the stack, since without bar 18 there may not be sufficient downward force provided by the weight of the stack against support 12*a* to cause engagement of feed roller 22 sufficient to drive each envelope into the feed gap.

In batch mode, the envelopes are of uniform width, and the operation of feeder 10 is the same as in automatic mode described above, except the feed gap is automatically set to the uniform thickness and maintained at this setting throughout feeding of the envelopes. The operator first selects batch mode via interface 6 to controller 8. A single envelope from a batch of envelopes is then placed on the envelope feeder and then advanced by the envelope feeder, or manually, into the feed gap until opto 44 senses the forward edge of the envelope. Alternatively, a rigid gauge, such as of plastic, equal to the uniform thickness may be used instead of a sample envelope. When controller 8 receives a signal from opto 44 indicating detection of the forward envelope edge, controller 8 automatically sets the feed gap to the sample envelope's thickness, i.e., the uniform thickness, by sending a signal to clutch/brake 40*a* to actuate. This locks the position or spacing of separation roller disks 28 with respect to disks 30. The sample envelope is removed and a stack of envelopes is then placed on supports 12*a* and 14. The operator then presses a start button or enters a start command on interface 6 to start feeding of envelopes. The feed gap based on the sample envelope will be maintained throughout successive feeding of the envelopes.

From the foregoing description, it will be apparent that there has been provided an improved envelope feeder. Variations and modifications in the herein described envelope feeder in accordance with invention will undoubtedly suggest themselves to those skilled in the art. Accordingly, the foregoing description should be taken as illustrative and not in a limiting sense.

What is claimed is:

1. An envelope feeder comprising:

a first member-presenting a first surface;

a second member having a second surface opposing said first surface;

said first member being movable with respect to said second member in response to each of a plurality of envelopes moving between said first and second surfaces;

a detector for sensing the presence of each of said plurality of envelopes as they each move between said first and second members; and means, responsive to said detector, for automatically controlling the spacing of said first member from said second member to set the gap between said first and second surfaces to match the thickness of each of said plurality of envelopes, whereby said envelopes move singularly between said first and second members, wherein each of said envelopes has a forward edge and a trailing edge opposite the forward edge, and said detector senses the presence of each of said plurality of envelopes by detecting said forward and trailing edges of each of said envelopes.

2. An envelope feeder comprising:

a first member presenting a first surface;

a second member having a second surface opposing said first surface;

said first member being movable with respect to said second member in response to each of a plurality of envelopes moving between said first and second surfaces;

a detector for sensing the presence of each of said plurality of envelopes as they each move between said first and second members;

means, responsive to said detector, for automatically controlling the spacing of said first member from said second member to set the gap between said first and second surfaces to match the thickness of each of said plurality of envelopes, whereby said envelopes move singularly between said first and second members; and means, responsive to said controlling means, for selectably advancing each of said envelopes into said gap between said first and second members.

3. The envelop feeder of claim 2 wherein said envelops can be of different thickness and said controlling means further comprises means for changing the spacing of said first member from said second member so that said gap matches each of said different thickness.

4. The envelope feeder of claim 1 wherein said plurality of envelopes are of substantially uniform thickness, and said controlling means further comprises means for placing said first and second members into fixed positions to set said gap to said uniform thickness to enable moving envelopes successively through said gap.

5. The envelope feeder of claim 2 further comprising means for successively advancing each of said envelopes into said gap between said first and second members.

6. The envelope feeder of claim 2 wherein said first member is comprised of a plurality of said first members to provide a plurality of said first surfaces spaced from each other, and said second member is comprised of a plurality of said second member to provide a plurality of said second surfaces spaced from each other in which each of said plurality of first surfaces is a continuous annular surface which interfit with different ones of said plurality of second surfaces.

7. The envelope feeder of claim 2 wherein said first surface has coefficient of friction greater than said second surface.

8. The envelope feeder of claim 2 wherein said controlling means further comprises a brake, coupled to said first member, for releasably fixing the position of said first member with respect to said second member to different envelope matching thicknesses.

9. The envelope feeder of claim 8 wherein said controlling means further comprises a pivotable shaft mechanically coupled to said first member in which said shaft has a first gear, and said brake comprises a magnetic clutch having second gear which engages said first gear such that said controlling means can send signals to said clutch to actuate said clutch, thereby fixing the position of said second gear, said first gear, and said shaft to fix the position of said first member with respect to said second member.

10. The envelope feeder of claim 8 wherein said detector sends first signals to said controlling means upon detecting the forward edge of each of said envelopes between said first and second members, and said controlling means being responsive to said first signals for actuating said brake to fix the position of said first member with respect to said second member to different envelope matching thicknesses.

11. The envelope feeder of claim 10 wherein said detector sends second signals to said controlling means upon detecting the trailing edge of each of said envelopes when no longer between said first and second members, and said controlling means being responsive to said second signals for releasing said brake to release the position of said first member with respect to said second member.

12. The envelope feeder of claim 2 wherein said plurality of envelopes are in a stack, and said envelope feeder further comprises support members presenting a surface for supporting said stack of envelopes to feed said envelopes singularly between said first and second members, and said advancing means further comprises a motor driven roller having one or more rotatable surfaces moveable into engaging relationship at the bottom of said stack through at least one opening in said surface.

13. The envelope feeder of claim 2 wherein each of said envelopes exits along a path from said feeder, and said envelope feeder further comprising another detector in said exiting path of each of said envelopes from said feeder which senses when to feed each of said plurality of envelopes into said gap, and said controlling means further comprises means for enabling said advancing means responsive to signals from said another detector.

14. The envelope feeder of claim 2 further comprising a pair of rollers spaced from each other to advance between them each of said plurality of envelopes after moving between said first and second members, wherein one of said rollers is motor driven.

15. The envelope feeder of claim 2 wherein said first surface is a continuous annular surface around an axis of rotation.

16. The envelope feeder of claim 2 wherein said controlling means further comprises means for biasing the first member towards said second member.

17. The envelope feeder of claim 2 further comprising members providing top and back support for said plurality of envelopes.

18. An envelope feeder comprising:

a first member presenting a first surface;

a second member having a second surface opposing said first surface;

said first member being movable with respect to said second member in response to each of a plurality of envelopes moving between said first and second surfaces;

a detector for sensing the presence of each of said plurality of envelopes as they each move between said first and second members; and means, responsive to said detector, for automatically controlling the spacing of said first member from said second member to set the gap between said first and second surfaces to match the thickness of each of said plurality of envelopes, whereby said envelopes move singularly between said first and second members, wherein said plurality of envelopes are in a stack, and said envelope feeder further comprises a support for said stack in which said support presents a surface to said stack such that the lower flat sides of the envelopes in said stack face said surface to position said envelopes for singular feeding between said first and second members, a bar moveable with respect to said stack, and means coupled to said bar for applying pressure with said bar against said stack toward said surface of said support.

19. The envelope feeder of claim 18 wherein said pressure applying means further comprises arms connected to said bar, a rotatable shaft having a gear connected to said shaft by a slip clutch in which said shaft is coupled to said arms for pivoting said arms, and a motor for applying rotational torque to said shaft via said gear in which said slip clutch limits the amount of torque applied to such shaft.

20. The envelope feeder of claim 18 wherein said pressure applying means further comprises proximity detectors for determining when said bar has reached approximately said support surface and when said bar has reached a predefined height from said support surface, and means for controlling the motion of said bar responsive to signals from said proximity detectors.

21. A method for feeding envelopes comprising the steps of:

providing a first member and a second member in which the surfaces of said first and second members oppose each other;

moving said first member with respect to said second member when one of a plurality of envelopes moves between the surfaces of said first and second members;

sensing the presence of said one envelope between said surfaces of said first and second members; and controlling the spacing of said first member from said second member to set the gap between the surfaces of said first and second members to match the thickness of said sensed one envelope.

22. The method of claim 21 wherein said controlling step further comprising the steps of resetting the gap for another of said plurality of envelopes when said one envelope has exited from between said first and second members, and said moving step, said sensing step, said controlling step, and said resetting step are operative upon said another envelope.

23. The method of claim 22 wherein said one envelope and said another envelope can be of different thicknesses, and said controlling step further comprises the step of changing the spacing of said first member from said second member so that said gap matches each of said different thicknesses.

24. The method of claim 21 wherein said plurality of envelopes are of substantially uniform thickness, and said controlling step further comprises the steps of placing said first and second members into fixed positions to set said gap to the uniform thickness of said one envelope, and enabling said first and second members to engage successively each of said plurality of envelopes as each of said plurality of envelopes moves through said gap.

25. The method of claim 24 wherein said one envelope is represented by a gauge member of said uniform thickness.

26. The method of claim 21 wherein said sensing step further comprises the steps of:

detecting the forward edge of said one envelope between said first and second members; and detecting the edge of said one envelope opposite said forward edge when said one envelope has exited from between said first and second members.

27. The method of claim 21 further comprising the step of selectably advancing each of said plurality of envelopes into said gap between said first and second members.

28. The method of claim 21 wherein said plurality of envelopes are in a stack, and said method further comprises the steps of:

presenting a support surface for said stack such that the lower flat sides of the envelopes in said stack face said surface to position said envelopes for singular feeding between said first and second members;

providing a bar moveable with respect to said stack; and applying pressure with said bar against said stack toward said support surface.

29. An envelope feeder for feeding envelopes from a stack of a plurality of said envelopes comprising:

a first member presenting a first surface;

a second member having a second surface opposing said first surface to define a gap between said first and second surfaces;

said first member being movable with respect to said second member in response to each of a plurality of envelopes moving between said first and second surfaces;

at least one detector for sensing the presence of each of said plurality of envelopes as they each move between said first and second members;

support members presenting a support surface for said stack of envelopes to feed said envelopes singularly between said first and second members; and a motor driven roller having one or more rotatable surfaces moveable into engaging relationship with said stack through at least one opening in said support surface to selectably advance each of said envelopes through said gap in accordance with said detector, wherein said gap is adjustable by movement of said first member as each of said envelopes advances through said gap.

30. The envelope feeder according to claim 29 further comprising:

means for pivoting said motor driven roller into and out of said opening in said support surface to selectably advance each of said envelopes when the envelope is adjacent said support surface.

31. An envelope feeder comprising:

a housing having a surface for supporting a stack of envelopes a feed roller in said housing and having an axis of rotation generally perpendicular to a feed direction along said surface;

an opening in said surface for passage of an envelope driving portion of said roller;

a shaft in said housing having an axis of rotation generally parallel to said axis of rotation of said feed roller; and a member extending radially from said axis of rotation of said shaft to said feed roller for pivotal movement upon rotation of said shaft moving said feed roller via said opening into and out of driving relationship with successive envelopes in said stack which rest on said surface and thereby applying with said feed roller pulses of driving force in said feed direction to successive envelopes in said stacks.

32. The envelope feeder of claim 31 further comprising means responsive to the passage of an envelope over said surface for actuating said shaft to pivot said feed roller into driving relationship with the envelope resting on said surface and applying a pulse of force on said envelope in said feed direction.

33. The envelope feeder of claim 32 further comprising means included in said actuating means for withdrawing said feed roller away from said opening out of said driving relationship between times when said pulses of driving force are applied.

* * * * *